US009926638B2

(12) United States Patent
Inoue et al.

(10) Patent No.: US 9,926,638 B2
(45) Date of Patent: Mar. 27, 2018

(54) ALUMINUM OR ALUMINUM ALLOY MOLTEN SALT ELECTROPLATING BATH HAVING GOOD THROWING POWER, ELECTROPLATING METHOD USING THE BATH, AND PRETREATMENT METHOD OF THE BATH

(75) Inventors: Manabu Inoue, Tokyo (JP); Akira Hashimoto, Chiba (JP); Tadahiro Onuma, Chiba (JP); Toshiki Inomata, Chiba (JP); Keisuke Nonomura, Chiba (JP); Naruaki Konno, Miyagi (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 80 days.

(21) Appl. No.: 13/977,879

(22) PCT Filed: Jan. 4, 2012

(86) PCT No.: PCT/JP2012/050017
§ 371 (c)(1),
(2), (4) Date: Jul. 1, 2013

(87) PCT Pub. No.: WO2012/093668
PCT Pub. Date: Jul. 12, 2012

(65) Prior Publication Data

US 2013/0292255 A1 Nov. 7, 2013

(30) Foreign Application Priority Data

Jan. 5, 2011 (JP) ..... 2011-000581

(51) Int. Cl.

| | |
|---|---|
| ***C25D 3/44*** | (2006.01) |
| ***C25D 3/56*** | (2006.01) |
| ***C25D 3/66*** | (2006.01) |
| ***C25D 5/18*** | (2006.01) |

(52) U.S. Cl.
CPC ..... *C25D 3/665* (2013.01); *C25D 3/44* (2013.01); *C25D 3/56* (2013.01); *C25D 5/18* (2013.01)

(58) Field of Classification Search
CPC ..... C25D 3/44; C25D 3/04–3/24; C25D 3/56; C25D 3/665; C25D 5/18
See application file for complete search history.

(56) References Cited

U.S. PATENT DOCUMENTS

| | | | | |
|---|---|---|---|---|
| 2,763,605 A | | 9/1956 | Miller et al. | |
| 3,929,611 A | * | 12/1975 | Hess | C25D 3/44 205/103 |
| 2004/0173468 A1 | * | 9/2004 | Henuset | C25D 3/42 205/261 |
| 2009/0176090 A1 | * | 7/2009 | So | C22C 32/0084 428/367 |

FOREIGN PATENT DOCUMENTS

| | | | | |
|---|---|---|---|---|
| AU | 23288/70 | | 12/1970 | |
| CN | 101210319 | | 7/2008 | |
| CN | 101545116 | | 9/2009 | |
| JP | 48-32266 | | 4/1973 | |
| JP | 61-213389 | | 9/1986 | |
| JP | 62-070592 | | 4/1987 | |
| JP | 05-148680 | | 6/1993 | |
| JP | 06-088282 | | 3/1994 | |
| JP | 07-157891 | | 6/1995 | |
| JP | 2006-161154 | | 6/2006 | |
| JP | 2008-13845 | | 1/2008 | |
| JP | 2008013845 A | * | 1/2008 | C25D 3/44 |
| JP | 2008-195989 | | 8/2008 | |
| JP | 2008-195990 | | 8/2008 | |
| JP | 2008195990 A | * | 8/2008 | C25D 3/44 |
| JP | 2009-173977 | | 8/2009 | |

OTHER PUBLICATIONS

Block et al., The Thermal Decomposition of Lithium Aluminum Hydride, Inorganic Chemistry, vol. 4, No. 3, Mar. 1965, pp. 304 to 305.*
Written Opinion of the International Searching Authority for PCT/JP2012/050017 dated Apr. 17, 2012 (English translation).
International Search Report for PCT/JP2012/050017 dated Apr. 17, 2012.
Office Action and Search Report for Chinese Patent Application No. 201280004661.0 dated May 4, 2015.
Extended European Search Report dated Jul. 11, 2017 for EP 12732441.6.
Jacob Block et al.: "The Thermal Decomposition of Lithium Aluminum Hydride—Inorganic Chemistry (ACS Publications)", Inorganic Chemistry, Mar. 1, 1965, pp. 304-305.

* cited by examiner

*Primary Examiner* — Ciel P Thomas
(74) *Attorney, Agent, or Firm* — James P. McParland; Foley & Lardner LLP

(57) ABSTRACT

The purpose of the present invention is to provide an electrical Al plating bath that poses little danger of exploding or igniting as a result of contacting air or water, and contains no benzene, toluene, xylene, naphthalene, or 1,3, 5-trimethylbenzene, which have detrimental effects to humans. The present invention provides an electrical aluminum or aluminum alloy fused salt plating bath that is obtained by heat treatment of an electrical aluminum or aluminum alloy fused salt plating bath containing (A) a halogenated aluminum as the primary component and (B) at least one other type of halide after adding (C) one, two or more reducible compounds selected from the group consisting of hydrides of elements in Group 1 Periods 2 through 6 of the Periodic Table of Elements and/or hydrides of Group 13 Periods 2 through 6 of the Periodic Table of Elements and amine borane compounds.

14 Claims, No Drawings

ALUMINUM OR ALUMINUM ALLOY MOLTEN SALT ELECTROPLATING BATH HAVING GOOD THROWING POWER, ELECTROPLATING METHOD USING THE BATH, AND PRETREATMENT METHOD OF THE BATH

CROSS-REFERENCE TO RELATED APPLICATIONS

The present application is a U.S. national stage application claiming the benefit of International Application No. PCT/JP2012/050017, which was filed on Jan. 4, 2012, which claims the benefit of priority to Japanese Patent Application number 2011-000581, filed Jan. 5, 2011. The entire contents of the foregoing are hereby incorporated herein by reference in their entireties.

TECHNICAL FIELD

The present invention relates to an aluminum or aluminum alloy molten salt electroplating bath usable at normal temperature.

BACKGROUND ART

Aluminum metal materials are well known to have excellent corrosion resistance. However, electrodeposition of aluminum from an aqueous solution is difficult, because aluminum has a high affinity for oxygen and has a reduction potential lower than hydrogen. For this reason, electroplating of aluminum has been conventionally carried out by using an organic solvent-based plating bath or a high-temperature molten salt bath. Here, typical examples of the organic solvent-based plating bath include those obtained by dissolving AlCl3 together with LiAlH4 or LiH in ether or in tetrahydrofuran, and a toluene solution of NaF.2Al(CH2H5)3. However, these baths have a problem of poor handleability, because the baths have risk of explosion upon contact with the air or water.

In this respect, a mixture molten salt bath containing an aluminum halide and an alkylpyridinium halide is proposed as a bath having no risk of explosion (Japanese Patent Application Publication No. Sho 62-70592). However, plating using this plating bath has the following problem. Specifically, the plating is poor in flatness and smoothness due to non-uniform electrodeposition. Especially when the film thickness is increased, or when a high current density is employed, dendritic deposits or black deposits are formed in a high-current density portion, and the deposits easily fall off. In addition, the throwing power of the plating is also so poor that the obtained plating film does not have an expected rust-prevention performance in a salt spray test or the like without a chromate treatment using hexavalent chromium. In this respect, as a method for solving the problems of the molten salt bath, a method has been proposed which uses benzene, toluene, xylene, or the like for dilution. However, it is not preferable to use a large amount of benzene, toluene, or xylene, because of their adverse effects on the human body, and risk of ignition due to their low flash points. This hinders the industrial application of the Al plating.

SUMMARY OF INVENTION

An object of the present invention is to provide an Al-based electroplating bath which has a low risk of explosion and ignition even upon contact with the air or water and which does not use any of benzene, toluene, xylene, naphthalene, and 1,3,5-trimethylbenzene having adverse effects on the human body. Another object of the present invention is to provide an Al-based electroplating bath capable of obtaining a plating film having a high corrosion resistance by forming a uniform plating film excellent in throwing power, in which no deposition of dendrite occurs and deposition of a black cationic nitrogen compound that is deposited competitively with aluminum is inhibited even in a high-current density portion. Still another object of the present invention is to provide a highly corrosion-resistant and rust-preventive film free from chromium.

The present invention provides an aluminum or aluminum alloy molten salt electroplating bath which is obtained by adding (C) a reducing compound which is one or more compounds selected from the group consisting of hydrides of elements in group 1 periods 2 to 6 in the periodic table and/or hydrides of elements in group 13 periods 2 to 6 in the periodic table, and amine borane compounds to an aluminum or aluminum alloy molten salt electroplating bath comprising (A) an aluminum halide as a main component and (B) at least one further halide, followed by a heat treatment.

The present invention provides a method for pretreating an aluminum or aluminum alloy molten salt electroplating bath comprising (A) an aluminum halide as a main component and (B) at least one further halide, the method comprising adding (C) a reducing compound which is one or more compounds selected from the group consisting of hydrides of elements in group 1 periods 2 to 6 in the periodic table and/or hydrides of elements in group 13 periods 2 to 6 in the periodic table, and amine borane compounds to the plating bath, followed by a heat treatment.

The present invention provides an electroplating method using the aluminum or aluminum alloy molten salt electroplating bath.

The plating bath of the present invention has no risk of explosion or ignition, and makes it possible to obtain a flat, smooth, and dense Al plating or Al alloy plating film. In addition, the film has a high corrosion resistance although being free from chromium. Hence, the film is expected to be applied as an environmentally friendly film widely to automobile parts, home appliance parts, and the like.

DESCRIPTION OF EMBODIMENTS

An aluminum or aluminum alloy molten salt electroplating bath of the present invention is obtained by adding, to an aluminum or aluminum alloy molten salt electroplating bath comprising (A) an aluminum halide as a main component and (B) at least one further halide, (C) a reducing compound which is one or more compounds selected from the group consisting of hydrides of elements in group 1 periods 2 to 6 in the periodic table, hydrides of elements in group 1 periods 2 to 6 and elements in group 13 periods 2 to 6 in the periodic table, and amine borane compounds, followed by a heat treatment.

The aluminum halide (A) used in the present invention is represented by $AlX_3$, where X is a halogen such as fluorine, chlorine, bromine, or iodine, and is preferably chlorine or bromine. In consideration of economic efficiently, chlorine is the most preferable.

The at least one further halide (B) used in the present invention is preferably a nitrogen-containing heteromonocyclic quaternary ammonium halide, and is more preferably an N-alkylpyridinium halide, an N-alkylimidazolium halide, an N,N'-dialkylimidazolium halide, an N-alkylpyrazolium halide, an N,N'-dialkylpyrazolium halide, an N-alkylpyrrolidinium halide, or an N, N-dialkylpyrrolidinium halide. One of these halides may be used alone, or two or more thereof may be used in combination. In addition, when two or more halides are used in combination, the halogen atoms may be a combination of two or more species.

The N-alkylpyridinium halide may have an alkyl group on the pyridine skeleton as a substituent, and is, for example, represented by the following general formula (I):

(I)

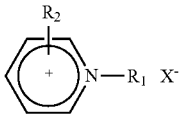

(in the formula, R1 is a linear, branched, or cyclic alkyl group having 1 to 12 carbon atoms, and is preferably a linear or branched alkyl group having 1 to 5 carbon atoms; R2 is a hydrogen atom or a linear, branched, or cyclic alkyl group having 1 to 6 carbon atoms, and is preferably a linear or branched alkyl group having 1 to 3 carbon atoms; and X is a halogen atom, which is most preferably a bromine atom in consideration of reactivity).

Specific examples of the N-alkylpyridinium halide include N-methylpyridinium chloride, N-ethylpyridinium chloride, N-butylpyridinium chloride, N-hexylpyridinium chloride, 2-methyl-N-propylpyridinium chloride, 3-methyl-N-ethylpyridinium chloride, those in which the chlorine in these chlorides is replaced with bromine or iodine, and the like.

The N-alkylimidazolium halide and the N,N'-dialkylimidazolium halide are, for example, represented by the following general formula (II):

(II)

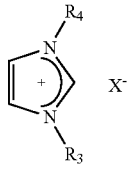

(in the formula, $R_3$ is a linear, branched, or cyclic alkyl group having 1 to 12 carbon atoms, and is preferably a linear or branched alkyl group having 1 to 5 carbon atoms; $R_4$ is a hydrogen atom or a linear, branched, or cyclic alkyl group having 1 to 6 carbon atoms, and is preferably a hydrogen atom or a linear or branched alkyl group having 1 to 3 carbon atoms; and X is a halogen atom, which is most preferably a bromine atom in consideration of reactivity).

Specific examples of the N-alkylimidazolium halide and the N,N'-alkylimidazolium halide include 1-methylimidazolium chloride, 1-ethylimidazolium chloride, 1-propylimidazolium chloride, 1-octylimidazolium chloride, 1-methyl-3-ethylimidazolium chloride, 1,3-dimethylimidazolium chloride, 1,3-diethylimidazolium chloride, 1-methyl-3-propylimidazolium chloride, 1-butyl-3-butylimidazolium chloride, those in which the chlorine in these chlorides is replaced with bromine or iodine, and the like.

The N-alkylpyrazolium halide and the N,N'-dialkylpyrazolium halide are, for example, represented by the following general formula (III):

(III)

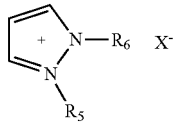

(in the formula, $R_5$ is a linear, branched, or cyclic alkyl group having 1 to 12 carbon atoms, and is preferably a linear or branched alkyl group having 1 to 5 carbon atoms; $R_6$ is a hydrogen atom or a linear, branched, or cyclic alkyl group having 1 to 6 carbon atoms, and is preferably a hydrogen atom or a linear or branched alkyl group having 1 to 3 carbon atoms; and X is a halogen atom, which is most preferably a bromine atom in consideration of reactivity).

Specific examples of the N-alkylpyrazolium halide and the N,N'-alkylpyrazolium halide include 1-methylpyrazolium chloride, 2-methylpyrazolium chloride, 1-propylpyrazolium chloride, 2-propylpyrazolium chloride, 1-butylpyrazolium chloride, 2-butylpyrazolium chloride, 1-hexylpyrazolium chloride, 2-benzylpyrazolium chloride, 1-methyl-2-ethylpyrazolium chloride, 1-methyl-2-propylpyrazolium chloride, 1-methyl-2-butylpyrazolium chloride, 1-methyl-2-hexylpyrazolium chloride, 1-methyl-2-benzylpyrazolium chloride, 1-propyl-2-methylpyrazolium chloride, 1-butyl-2-methylpyrazolium chloride, 1-hexyl-2-methylpyrazolium chloride, 1,2-dimethylpyrazolium chloride, 1,2-diethylpyrazolium chloride, those in which the chlorine in these chlorides is replaced with bromine or iodine, and the like.

The N-alkylpyrrolidinium halide and the N,N'-dialkylpyrrolidinium halide may have an alkyl group on the pyrrolidinium skeleton as a substituent, and are, for example, represented by the following general formula (IV):

(IV)

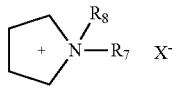

(in the formula, $R_7$ is a hydrogen atom or a linear, branched, or cyclic alkyl group having 1 to 12 carbon atoms, and is preferably a hydrogen atom or a linear or branched alkyl group having 1 to 5 carbon atoms; $R_8$ is a hydrogen atom or a linear, branched, or cyclic alkyl group having 1 to 6 carbon atoms, and is preferably a hydrogen atom or a linear or branched alkyl group having 1 to 3 carbon atoms, provided that a case where both $R_7$ and $R_8$ are hydrogen atoms is excluded; and X is a halogen atom, which is most preferably a bromine atom in consideration of reactivity).

Specific examples of the N-alkylpyrrolidinium halide include N-methylpyrrolidinium chloride, N-ethylpyrrolidinium chloride, N-butylpyrrolidinium chloride, N-hexylpyrrolidinium chloride, 2-methyl-N-propylpyrrolidinium chloride, 3-methyl-N-ethylpyrrolidinium chloride, N-methyl-N-ethylpyrrolidinium chloride, N-methyl-N-propylpyrrolidinium chloride, N-methyl-N-butylpyrrolidinium chloride, N-diethylpyrrolidinium chloride, N-ethyl-N-propylpyrrolidinium chloride, N-ethyl-N-butylpyrrolidinium chloride, those in which the chlorine in these chlorides is replaced with bromine or iodine, and the like.

In the present invention, the ratio between the number of moles of the aluminum halide (A) to the number of moles of the further halide (B) is preferably in a range from 1:1 to 3:1, and is more preferably 2:1. When the molar ratio falls within such a range, a reaction which is presumably decomposition of the pyridinium, imidazolium, pyrazolium, or pyrrolidinium cations can be suppressed, and the increase in viscosity of the plating bath can be suppressed. Consequently, degradation of the plating bath and plating failure can be prevented.

The reducing compounds (C) used in the present invention are hydrides of elements in group 1 periods 2 to 6 in the periodic table and/or hydrides of elements in group 13 periods 2 to 6 in the periodic table and amine borane compounds. One of these reducing compounds may be used alone, or two or more thereof may be used in combination. The elements in group 1 periods 2 to 6 in the periodic table mean Li, Na, K, Rb, and Cs. Of these elements, elements in periods 2 and 3 (i.e., Li and Na) are preferable. Meanwhile, the elements in group 13 periods 2 to 6 mean B, Al, Ca, In, and Tl. Of these elements, elements in periods 2 and 3 (i.e., B and Al) are preferable. The amine borane compounds are reaction products of Na borohydride with amines. The reducing compound (C) is preferably lithium aluminum hydride, lithium hydride, lithium sodium hydride, sodium hydride, sodium borohydride, dimethylamine borane, diethylamine borane, or trimethylamine borane. The reducing compound (C) is more preferably lithium aluminum hydride or dimethylamine borane. The amount of the reducing compound added is preferably 0.01 g/L to 100 g/L, more preferably 0.05 g/L to 30 g/L, and further preferably 0.1 g/L to 10 g/L.

After the addition of the reducing compound (C), the aluminum or aluminum alloy molten salt electroplating bath of the present invention is subjected to a heat treatment. The heat treatment includes heating in a range preferably from 50 to 100° C., and more preferably 60 to 80° C. The heating causes decomposition of the reducing compound (C). In the decomposition, $H_2$ gas is generated. The $H_2$ gas may be let out of the liquid, but the $H_2$ gas does not necessarily have to be let out. Preferably, the generated $H_2$ gas is let out of the plating liquid. Examples of the method for letting the $H_2$ gas out of the plating liquid include a method in which the $H_2$ gas is spontaneously let out by continuing the heating, a method of applying ultrasonic waves, a method in which bubbling is performed with a dry inert gas, and the like. Any ones of these methods may be used in combination. Examples of the inert gas include nitrogen, argon, and the like.

In the method in which the gas is spontaneously let out by continuing the heating, the time for which the heating is continued is preferably 0.5 to 24 hours, and more preferably 1 to 8 hours.

In the method of applying ultrasonic waves, the frequency of the ultrasonic waves is preferably 20 to 60 KHz, and more preferably 30 to 40 KHz. The time for which the ultrasonic waves are applied is preferably 10 to 60 minutes, and more preferably 20 to 40 minutes.

In the method in which the bubbling is performed with a dry inert gas, the bubbling temperature is preferably 10 to 120° C., and more preferably 80 to 100° C. The bubbling time is preferably 10 to 60 minutes, and more preferably 20 to 40 minutes.

The aluminum or aluminum alloy molten salt electroplating bath of the present invention achieves (1) improvement in electrical conductivity of the bath and (2) facilitation of deposition of aluminum because of shift of the reduction potential of aluminum in a nobler direction, so that improvement in throwing power can also be achieved.

Regarding the aluminum or aluminum alloy molten salt electroplating bath of the present invention, it is further preferable to remove impurity metals originating from the aluminum halide (A) in the plating bath. As the impurity metals, iron, copper, and the like are contained. Examples of said removing the impurity metals in the plating bath include a process in which the impurity metals are removed by immersing an Al wire or an Al powder in the plating liquid; a process in which the impurity metals are removed by placing a cathode aluminum plate or an anode aluminum plate in the plating liquid and applying a current therethrough; and the like. Consequently, the impurity metals such as iron and copper are removed. This further improves the throwing power, and a dense plating film can be obtained.

When the impurity metals are removed by immersing an Al wire or an Al powder in the plating liquid, heating is carried out at a temperature of preferably 10 to 120° C., and more preferably 80 to 100° C. The heating time is preferably 2 to 96 hours, and more preferably 24 to 72 hours.

When the impurity metals are removed by placing a cathode aluminum plate or an anode aluminum plate in the plating liquid, and applying a current therethrough, the bath temperature is preferably a temperature of 50 to 120° C., and more preferably a temperature of 80 to 100° C. The cathode current density is preferably 0.1 to 10 A/dm2, and more preferably 1 to 5 A/dm2. The amount of the current applied to the plating bath is preferably 10 AH/L to 20 AH/L, and more preferably 15 to 20 AH/L. The removal of the impurity metals may be conducted after construction of the aluminum or aluminum alloy molten salt plating bath, before the addition of the reducing compound (C), or after the addition of the reducing compound (C). The removal of the impurity metals is preferably conducted before the addition of the reducing compound (C).

The aluminum or aluminum alloy molten salt electroplating bath of the present invention may further comprise a compound (D) of a metal such as Zr, Ti, Mo, W, Mn, Ni, Co, Sn, Zn, Si, Nd, or Dy. The compound (D) is, for example, a halide, and specific examples thereof include zirconium tetrachloride, titanium tetrachloride, manganese chloride, molybdenum chloride, tungsten chloride, and the like. One of these compounds may be used alone, or two or more thereof may be used in combination. The content of the compound (D) is preferably 0.1 to 100 g/L, and more preferably 0.1 to 10 g/L. When the content of the compound (D) falls within such a range, an effect of the metal forming the aluminum alloy plating is exhibited, and no black powdery deposit is formed. For example, when $ZrCl_4$ is added, Al—Zr alloy plating is formed, and the corrosion-resistance is improved. When $MnCl_2$ is further added thereto, Al—Zr—Mn alloy plating is formed, and the gloss and the uniformity in appearance are enhanced.

The aluminum or aluminum alloy molten salt electroplating bath of the present invention may further comprise an organic polymer (E). Examples of the organic polymer (E) include styrene-based polymers, aliphatic diene-based polymers, and the like. One of these organic polymers may be used alone, or two or more thereof may be used in combination.

Examples of the styrene-based polymers include styrene-based homopolymers such as styrene, α-methylstyrene, vinyltoluene, and m-methylstyrene: copolymers thereof; and copolymers of a styrene-based monomer with another polymerizable vinyl monomer. Examples of the vinyl monomer include maleic anhydride, maleic acid, acrylic acid, methacrylic acid, methyl methacrylate, glycidyl methacrylate, itaconic acid, acrylamide, acrylonitrile, maleimide, vinylpyridine, vinylcarbazole, acrylic acid esters, methacrylic acid esters, fumaric acid esters, vinyl ethyl ether, vinyl chloride, and the like. Of these vinyl monomers, α,β-unsaturated carboxylic acids having 3 to 10 carbon atoms and alkyl (having 1 to 3 carbon atoms) esters thereof are preferable.

Examples of the aliphatic diene-based polymers include polymers of butadiene, isoprene, pentadiene, or the like, etc. The aliphatic diene-based polymer is preferably a polymer having branched chains with a 1,2 or 3,4 structure, or a copolymer of the polymer with another polymerizable vinyl monomer. Examples of the vinyl monomer include the same vinyl monomers as mentioned in the description for the styrene-based polymer.

The weight average molecular weight of the organic polymer (E) is preferably in a range from 200 to 80000, and more preferably in a range from 300 to 5000. In particular, low- or medium-molecular weight polystyrenes and poly-α-methylstyrenes each having a weight average molecular weight of about 300 to 5000 are the most preferable because of good solubility in molten salts. The content of the organic polymer (E) is preferably in a range from 0.1 to 50 g/l, and more preferably in a range from 1 to 10 g/l. When the organic polymer is used within such a range, the deposition of dendrite can be prevented, and the organic polymer exhibits a surface flattening and smoothing effect, so that burnt deposit can be prevented from occurring.

The aluminum or aluminum alloy molten salt electroplating bath of the present invention may further comprise a brightening agent (F). Examples of the brightening agent (F) include aliphatic aldehydes, aromatic aldehydes, aromatic ketones, nitrogen-containing unsaturated heterocyclic compounds, hydrazide compounds, S-containing heterocyclic compounds, S-containing aromatic hydrocarbons having substituents, aromatic carboxylic acids, derivatives thereof, aliphatic carboxylic acids having double bonds, derivatives thereof, acetylene alcohol compounds, trifluorochloroethylene resins, and the like. One of these brightening agents may be used alone, or two or more thereof may be used in combination.

The aliphatic aldehydes are, for example, aliphatic aldehydes having 2 to 12 carbon atoms, and specific examples thereof include tribromoacetaldehyde, metaldehyde, 2-ethylhexyl aldehyde, lauryl aldehyde, and the like.

The aromatic aldehydes are, for example, aromatic aldehydes having 7 to 10 carbon atoms, and specific examples thereof include O-carboxybenzaldehyde, benzaldehyde, O-chlorobenzaldehyde, p-tolualdehyde, anisaldehyde, p-dimethylaminobenzaldehyde, terephthalaldehyde, and the like.

The aromatic ketones are, for example, aromatic ketones having 8 to 14 carbon atoms, and specific examples thereof includes benzalacetone, benzophenone, acetophenone, terephthaloyl benzyl chloride, and the like.

The nitrogen-containing unsaturated heterocyclic compounds are, for example, nitrogen-containing heterocyclic compounds having 3 to 14 carbon atoms, and specific examples thereof include pyrimidine, pyrazine, pyridazine, s-triazine, quinoxaline, phthalazine, 1,10-phenanthroline, 1,2,3-benzotriazole, acetoguanamine, cyanuric chloride, imidazole-4-acrylic acid, and the like.

Examples of the hydrazide compounds include maleic hydrazide, isonicotinic hydrazide, phthalic hydrazide, and the like.

The S-containing heterocyclic compounds are, for example, S-containing heterocyclic compounds having 3 to 14 carbon atoms, and specific examples thereof include thiouracil, thionicotinamide, s-trithiane, 2-mercapto-4,6-dimethylpyrimidine, and the like.

The S-containing aromatic hydrocarbons having substituents are, for example, S-containing aromatic hydrocarbons having substituents and having 7 to 20 carbon atoms, and specific example thereof include thiobenzoic acid, thioindigo, thioindoxyl, thioxanthene, thioxanthone, 2-thiocoumarin, thiocresol, thiodiphenylamine, thionaphthol, thiophenol, thiobenzamide, thiobenzanilide, thiobenzaldehyde, thionaphthenequinone, thionaphthene, thioacetanilide, and the like.

The aromatic carboxylic acids and derivatives thereof are, for example, aromatic carboxylic acids having 7 to 15 carbon atoms and derivatives thereof, and specific examples thereof include benzoic acid, terephthalic acid, ethyl benzoate, and the like.

The aliphatic carboxylic acids having double bonds and derivatives thereof are, for example, aliphatic carboxylic acids having double bonds and having 3 to 12 carbon atoms and derivatives thereof, and specific examples thereof include acrylic acid, crotonic acid, methacrylic acid, 2-ethylhexyl acrylate, 2-ethylhexyl methacrylate, and the like.

Examples of the acetylene alcohol compounds include propargyl alcohol and the like.

Examples of the trifluorochloroethylene resins include trifluorochloroethylene resins having average molecular weights of 500 to 1300, and the like.

The content of the brightening agent is preferably in a range from 0.001 to 0.1 mol/l, and more preferably in a range from 0.002 to 0.02 mol/l. When the brightening agent is used within such a range, a flattening and smoothing effect can be obtained, and even when plating is conducted with a high current density, no deposit like black smut is formed.

An electroplating method of the present invention is carried out by using the above-described aluminum or aluminum alloy molten salt electroplating bath. The electroplating can be conducted with a direct or pulse current, and a pulse current is particularly preferable. When a pulse current is used, the duty ratio (ON/OFF ratio) is preferably 1:2 to 2:1, and most preferably 1:1. It is preferable to use a pulse current under conditions that the ON time is 5 to 20 ms and the OFF time is 5 to 20 ms, because electrodeposited particles become dense, flat, and smooth. The bath temperature is generally in a range from 25 to 120° C., and preferably in a range from 50 to 100° C. The current density is generally in a range from 0.1 to 15 $A/dm^2$, and preferably in a range from 0.5 to 5 $A/dm^2$. Note that although the molten salt plating bath of the present invention is safe even in contact with oxygen or water, it is desirable to conduct the electroplating in a dry oxygen-free atmosphere (in dry nitrogen, dry argon, or dry air), form the viewpoints of the maintenance of the stability of the plating bath, properties of the plating, and the like. In addition, it is desirable to stir the bath and/or rock workpieces in conducting the electroplating. For example, the current density can be further increased, when a jet stream, ultrasonic wave stirring, or the like is employed. In addition, the electroplating method of the present invention is preferably carried out by using a barrel plating apparatus.

Next, the present invention is described, while showing Examples and Comparative Examples.

EXAMPLES

Example 1

A 99.9% Al wire was immersed in a bath obtained by mixing and melting $AlCl_3$ and 1-methyl-3-propylimidazolium bromide at a molar ratio of 2:1, and the bath was heated at 80° C. for 48 hours. After that, the bath was filtrated, and 3 g/L of dimethylamine borane was added, and the bath was heated at 80° C. for 1 hour. Thus, a plating bath was prepared. Next, a Hull cell copper plate (plate thickness: 0.5 mm) to be used as a cathode was subjected to pretreatments including alkali degreasing, electrolytic alkaline cleaning, acid pickling, washing with water, subsequent washing with ethyl alcohol, and drying. While the pretreated copper plate was used as the cathode, and an aluminum plate (purity: 99.9%) was used as the anode, Al plating was conducted in a dry nitrogen gas atmosphere at a bath temperature of 50° C. with a pulse (duty ratio: 1:1, ON and OFF times: 10 ms) of 1 A for 20 minutes. Note that the plating bath was stirred with a stirrer. Table 1 shows the electric conductivity of the plating liquid, the reduction potential of the Al plating, and the throwing power obtained based on the Hull cell appearance.

Example 2

A 99.9% Al wire was immersed in a bath obtained by mixing and melting $AlCl_3$ and 1-methyl-3-propylimidazolium bromide at a molar ratio of 2:1, and the bath was heated at 80° C. for 48 hours. After that, the bath was filtered, 0.5 g/L of lithium aluminum hydride was added, and the bath was heated at 80° C. for 1 hour. Thus, a plating bath was prepared. Next, a Hull cell copper plate (plate thickness: 0.5 mm) to be used as a cathode was subjected to pretreatments including alkali degreasing, electrolytic alkaline cleaning, acid pickling, washing with water, subsequent washing with ethyl alcohol, and drying. While the pretreated copper plate was used as the cathode, and an aluminum plate (purity: 99.9%) was used as the anode, Al plating was conducted in a dry nitrogen gas atmosphere at a bath temperature of 50° C. with a pulse (duty ratio: 1:1, ON and OFF times: 10 ms) of 1 A for 20 minutes. Note that the plating bath was stirred with a stirrer. Table 1 shows the electric conductivity of the plating liquid, the reduction potential of the Al plating, and the throwing power obtained based on the Hull cell appearance.

Example 3

A 99.9% Al wire was immersed in a bath obtained by mixing and melting $AlCl_3$ and 1-methyl-3-propylimidazolium bromide at a molar ratio of 2:1, and the bath was heated at 80° C. for 48 hours. To the bath, 3 g/L of anhydrous zirconium chloride and 3 g/L of anhydrous manganese chloride were added and dissolved. After that, the bath was filtrated, 3 g/L of dimethylamine borane was added, and the bath was heated at 80° C. for 1 hour. Thus, a plating bath was prepared. Next, a Hull cell copper plate (plate thickness: 0.5 mm) to be used as a cathode was subjected to pretreatments including alkali degreasing, electrolytic alkaline cleaning, acid pickling, washing with water, subsequent washing with ethyl alcohol, and drying. While the pretreated copper plate was used as the cathode, and an aluminum plate (purity: 99.9%) was used as the anode, Al plating was conducted in a dry nitrogen gas atmosphere at a bath temperature of 50° C. with a pulse (duty ratio: 1:1, ON and OFF times: 10 ms) of 1 A for 20 minutes. Note that the plating bath was stirred with a stirrer. Table 1 shows the electric conductivity of the plating liquid, and the throwing power obtained based on the Hull cell appearance.

Example 4

A 99.9% Al wire was immersed in a bath obtained by mixing and melting $AlCl_3$ and 1-methyl-3-propylimidazolium bromide at a molar ratio of 2:1, and the bath was heated at 80° C. for 48 hours. To the bath, 3 g/L of anhydrous zirconium chloride and 3 g/L of anhydrous manganese chloride were added and dissolved. After that, the bath was filtered, 0.5 g/L of lithium aluminum hydride was added, and the bath was heated at 80° C. for 1 hour. Thus, a plating bath was prepared. Next, a Hull cell copper plate (plate thickness: 0.5 mm) to be used as a cathode was subjected to pretreatments including alkali degreasing, electrolytic alkaline cleaning, acid pickling, washing with water, subsequent washing with ethyl alcohol, and drying. While the pretreated copper plate was used as the cathode, and an aluminum plate (purity: 99.9%) was used as the anode, Al plating was conducted in a dry nitrogen gas atmosphere at a bath temperature of 50° C. with a pulse (duty ratio: 1:1, ON and OFF times: 10 ms) of 1 A for 20 minutes. Note that the plating bath was stirred with a stirrer. Table 1 shows the electric conductivity of the plating liquid, and the throwing power obtained based on the Hull cell appearance.

Comparative Example 1

A 99.9% Al wire was immersed in a bath obtained by mixing and melting $AlCl_3$ and 1-methyl-3-propylimidazolium bromide at a molar ratio of 2:1, and the bath was heated at 80° C. for 48 hours. After that, the bath was filtered. Thus, a plating bath was prepared. Next, a Hull cell copper plate to be used as a cathode was subjected to pretreatments including alkali degreasing, electrolytic alkaline cleaning, acid pickling, washing with water, subsequent washing with ethyl alcohol, and drying. While the pretreated copper plate was used as the cathode, and an aluminum plate (purity: 99.9%) was used as the anode, Al plating was conducted in a dry nitrogen gas atmosphere at a bath temperature of 50° C. with a pulse (duty ratio: 1:1, ON and OFF times: 10 ms). Note that the plating bath was stirred with a stirrer. Table 1 shows the electric conductivity of the plating liquid, the reduction potential of the Al plating, and the throwing power obtained based on the Hull cell appearance.

Comparative Example 2

A 99.9% Al wire was immersed in a bath obtained by mixing and melting $AlCl_3$ and 1-methyl-3-propylimidazolium bromide at a molar ratio of 2:1, and the bath was heated at 80° C. for 48 hours. To the bath, 3 g/L of anhydrous zirconium chloride and 3 g/L of anhydrous manganese chloride were added and dissolved. After that, the bath was filtered. Thus, a plating bath was prepared. Next, a Hull cell copper plate to be used as a cathode was subjected to pretreatments including alkali degreasing, electrolytic alkaline cleaning, acid pickling, washing with water, subsequent washing with ethyl alcohol, and drying. While the pretreated copper plate was used as the cathode, and an aluminum plate (purity: 99.9%) was used as the anode, Al plating was conducted in a dry nitrogen gas atmosphere at a bath temperature of 50° C. with a pulse (duty ratio: 1:1, ON and OFF times: 10 ms). Note that the plating bath was stirred with a stirrer. Table 1 shows the electric conductivity of the plating liquid, and the throwing power obtained based on the Hull cell appearance.

Example 5

A 99.9% Al wire was immersed in a bath obtained by mixing and melting $AlCl_3$ and 1-methyl-3-propylimidazolium bromide at a molar ratio of 2:1, and the bath was heated at 80° C. for 48 hours. After that, the bath was filtrated, 3 g/L of dimethylamine borane was added to the bath, and the bath was heated at 80° C. for 1 hour. Further, 0.5 g/L of phenanthroline was added and mixed in the bath. Thus, a plating bath was prepared. Next, a Hull cell copper plate (plate thickness: 0.5 mm) to be used as a cathode was subjected to pretreatments including alkali degreasing, electrolytic alkaline cleaning, acid pickling, washing with water, subsequent washing with ethyl alcohol, and drying. While the pretreated copper plate was used as the cathode, and an aluminum plate (purity: 99.9%) was used as the anode, Al plating was conducted in a dry nitrogen gas atmosphere at a bath temperature of 50° C. with a pulse (duty ratio: 1:1, ON and OFF times: 10 ms) of 1 A for 20 minutes. Note that the plating bath was stirred with a stirrer. Table 1 shows the electric conductivity of the plating liquid, the reduction potential of the Al plating, and the throwing power obtained based on the Hull cell appearance.

Example 6

A 99.9% Al wire was immersed in a bath obtained by mixing and melting $AlCl_3$ and 1-methyl-3-propylimidazolium bromide at a molar ratio of 2:1, and the bath was heated at 80° C. for 48 hours. After that, the bath was filtered, 0.5 g/L of lithium aluminum hydride was added, and the bath was heated at 80° C. for 1 hour. Further, 2.5 g/L of a polystyrene (Piccolastic A-75) was added and mixed. Thus, a plating bath was prepared. Next, a Hull cell copper plate (plate thickness: 0.5 mm) to be used as a cathode was subjected to pretreatments including alkali degreasing, electrolytic alkaline cleaning, acid pickling, washing with water, subsequent washing with ethyl alcohol, and drying. While the pretreated copper plate was used as the cathode, and an aluminum plate (purity: 99.9%) was used as the anode, Al plating was conducted in a dry nitrogen gas atmosphere at a bath temperature of 50° C. with a pulse (duty ratio: 1:1, ON and OFF times: 10 ms) of 1 A for 20 minutes. Note that, the plating bath was stirred with a stirrer. Table 1 shows the electric conductivity of the plating liquid, the reduction potential of the Al plating, and the throwing power obtained based on the Hull cell appearance.

TABLE 1

| | Reduction potential (V) | Electric conductivity at 25° C. (mS/cm) | Throwing power (distance of plating from large-current side (cm)) |
|---|---|---|---|
| Example 1 | −0.55 | 28 | 10 |
| Example 2 | −0.30 | 26 | 9 |
| Example 3 | — | 29 | 10 |
| Example 4 | — | 27 | 9 |
| Comp. Ex. 1 | −0.65 | 20 | 6 |
| Comp. Ex. 2 | — | 19 | 7 |
| Example 5 | −0.57 | 28 | 9 |
| Example 6 | −0.32 | 26 | 9 |

The invention claimed is:

1. An aluminum or aluminum alloy molten salt plating bath which is obtained by adding (C) a reducing compound which is one or more compounds selected from the group consisting of lithium aluminum hydride, lithium hydride, lithium sodium hydride, sodium hydride, sodium borohydride, dimethylamine borane, diethylamine borane, and trimethylamine borane to a bath comprising (A) an aluminum halide as a main component and (B) at least one further halide, wherein the further halide (B) is one or more compounds selected from the group consisting of N-alkylpyridinium halides, N-alkylimidazolium halides, N,N'-dialkylimidazolium halides, N-alkylpyrazolium halides, N,N'-dialkylpyrazolium halides, N-alkylpyrrolidinium halides, and N, N-dialkylpyrrolidinium halides, followed by a heat treatment, wherein the heat treatment includes decomposing the reducing compound (C) by heating the bath at a temperature of 50 to 100° C. for 0.5 to 8 hours, and wherein the plating bath is for electrolytic applications, and the plating bath contains no organic solvent.

2. The aluminum or aluminum alloy molten salt plating bath according to claim 1, wherein the reducing compound (C) is lithium aluminum hydride and/or dimethylamine borane.

3. The aluminum or aluminum alloy molten salt plating bath according to claim 1, wherein the aluminum halide (A) and the further halide (B) are contained at a molar ratio of from 1:1 to 3:1.

4. The aluminum or aluminum alloy molten salt plating bath according to claim 1, wherein the heat treatment includes letting generated $H_2$ gas out of the bath.

5. The aluminum or aluminum alloy molten salt plating bath according to claim 1, wherein the plating bath is obtained by removing an impurity metal originating from the aluminum halide (A) in the bath.

6. The aluminum or aluminum alloy molten salt plating bath according to claim 5, wherein said removing the impurity metal is a process in which the impurity metal is removed by immersing an Al wire or Al powder in the plating liquid, or a process in which the impurity metal is removed by placing a cathode aluminum plate or an anode aluminum plate in the plating liquid and applying a current therethrough.

7. The aluminum or aluminum alloy molten salt plating bath according to claim 5, wherein the impurity metal is iron and/or copper.

8. The aluminum or aluminum alloy molten salt plating bath according to claim 1, further comprising compounds (D) of one or more metals selected from the group consisting of Zr, Ti, Mo, W, Mn, Ni, Co, Sn, Zn, Si, Nd, and Dy in the amount of 0.1 to 100 g/l.

9. The aluminum or aluminum alloy molten salt plating bath according to claim 1, further comprising 0.1 to 50 g/l of an organic polymer.

10. The aluminum or aluminum alloy molten salt plating bath according to claim 1, further comprising 0.001 to 0.1 mol/l of a brightening agent.

11. An electroplating method comprising contacting a metal with the aluminum or aluminum alloy molten salt plating bath according to claim 1.

12. The electroplating method according to claim 11, wherein a pulse current is used in the contacting step.

13. The electroplating method according to claim 11, wherein the contacting step comprises the use of a barrel plating apparatus.

14. A method for pretreating an aluminum or aluminum alloy molten salt plating bath comprising (A) an aluminum halide as a main component and (B) at least one further halide, the method comprising adding (C) a reducing compound which is one or more compounds selected from the group consisting of lithium aluminum hydride, lithium hydride, lithium sodium hydride, sodium hydride, sodium borohydride, dimethylamine borane, diethylamine borane, and trimethylamine borane to a bath comprising (A) the aluminum halide as a main component and (B) the at least one further halide, wherein the further halide (B) is one or more compounds selected from the group consisting of N-alkylpyridinium halides, N-alkylimidazolium halides, N,N'-dialkylimidazolium halides, N-alkylpyrazolium halides, N,N'-dialkylpyrazolium halides, N-alkylpyrrolidinium halides, and N, N-dialkylpyrrolidinium halides, followed by a heat treatment, wherein the heat treatment includes decomposing the reducing compound (C) by heating the bath at a temperature of 50 to 100° C. for 0.5 to 8 hours, and wherein the plating bath is for electrolytic applications, and the plating bath contains no organic solvent.

* * * * *